US005996327A

United States Patent [19]

Mack

[11] Patent Number: 5,996,327

[45] Date of Patent: Dec. 7, 1999

[54] METHOD OF AND APPARATUS FOR TRANSPORTING FULL BOBBINS AND EMPTY BOBBIN CORES

[75] Inventor: Karl-Heinz Mack, Weilheim/Teck, Germany

[73] Assignee: Zinser Textilmaschinen GmbH, Ebersbach/Fils, Germany

[21] Appl. No.: 09/010,327

[22] Filed: Jan. 21, 1998

[30] Foreign Application Priority Data

Jan. 22, 1997 [DE] Germany ..... 197 02 163

[51] Int. Cl.[6] ..... D01H 9/10

[52] U.S. Cl. ..... 57/281; 57/273; 57/274; 57/267; 57/266; 57/90

[58] Field of Search ..... 57/281, 90, 266, 57/267, 273, 274

[56] References Cited

U.S. PATENT DOCUMENTS 4,897,992 2/1990 Kogiso et al. ..... 57/281

5,628,174 5/1997 Mack et al. ..... 57/281

FOREIGN PATENT DOCUMENTS 0 306 450 3/1989 European Pat. Off. .

195 05 050 C2 8/1996 Germany .

195 18 091 A1 11/1996 Germany .

58-81631 11/1981 Japan .

*Primary Examiner*—William Stryjewski

*Attorney, Agent, or Firm*—Herbert Dubno

[57] ABSTRACT

A horizontal transporter at a roving frame level delivers full bobbins to a vertical movable carriage which picks up the bobbins from the bottom, replaces them with core sleeves, and lodges the bobbins in a second horizontal transporter at another story for the ring spinning units. The bobbin and core sleeves are always engaged from above by the horizontal transporters and remain erect when engaged from below by the vertical transporter.

16 Claims, 5 Drawing Sheets

METHOD OF AND APPARATUS FOR TRANSPORTING FULL BOBBINS AND EMPTY BOBBIN CORES

FIELD OF THE INVENTION

My present invention relates to a method of and to an apparatus for transporting full bobbins and empty bobbin cores. More particularly, the invention relates to systems in which transport paths in different horizontal planes are provided for full bobbins and empty bobbin cores, especially for roving bobbins and cores or core sleeves or tubes on which roving is to be wound to form the bobbins. The invention is especially applicable to yarn-producing mills, factories or plants in which roving frames are located at one level, spinning frames, especially ring-spinning frames, are located at another level, each level is provided with a respective horizontal transporter in a respective horizontal plane, and roving bobbins and empty bobbin cores must be transferred between these planes and transporters.

BACKGROUND OF THE INVENTION

A spinning factory in which two distinct levels or stories are provided and roving bobbins are transported between these levels, is described in EP 0 306 450 B1. In that system, a belt conveyor interconnects the upper and lower levels and at the upper level the bobbins are suspended, i.e. engaged from above by hangers, whereas at the lower level, the bobbins are supported from below on a horizontal conveyor belt.

There also may be systems available in which, between the levels, the bobbins or the core sleeves must be so reoriented that they are brought from an upright position into a horizontal or prone position and vice versa.

All of these systems are relatively complex, require expensive equipment and high maintenance and installation costs. The systems may not be easily compatible with the horizontal transporters or may not be easily accommodated to the requirements of horizontal transporters used in spinning plants.

OBJECTS OF THE INVENTION

It is, therefore, the principal object of the present invention to provide a method of and an apparatus for the transporting of full bobbins, especially roving bobbins and empty bobbin cores, which can effect transfer of the bobbins and cores between transporters or transport paths at different levels at low capital and operating costs and without other drawbacks of earlier systems as outlined above.

It is also an object of this invention to provide an improved system for the transporting of roving bobbins and empty bobbin cores, especially where the roving frames are provided at one level and the ring-spinning frames are provided at another which can effect a more reliable and problem-free transfer of the bobbins and cores between the transport levels.

It is also an object of the invention to provide a method of and an apparatus for the transporting of bobbins and cores which will obviate drawbacks of earlier systems.

SUMMARY OF THE INVENTION

These objects and others which will become apparent hereinafter, in accordance with the invention in a system in which the bobbins or cores are displaced in a first plane by a first transport device or unit, hereinafter referred to as a first transport path or a first transporter, and which operatively connects with a transport and replacement unit which is vertical and connects the first transporter with a second transporter in a second plane vertically offset from the first and provided with a second transport unit or device and hence a second transporter.

According to the invention, the transporters in both the first and second plane suspend the upright bobbins and cores from respective hangers, while the bobbin/core replacement unit which also acts as a transporter between the two horizontal unit, engages the bobbins and sleeves from below, the bobbins and sleeves or cores remain erect in the respective horizontal planes and in travel between these planes.

Because the first and second horizontal transporters both engage the bobbins and core from above, i.e. the bobbins and cores are suspended in both horizontal transporters, the vertical transporter with the planes and the transfer means for shifting the cores or bobbins from the horizontal transporter to the vertical transporter can be greatly simplified. The vertical transporter thus has a bobbin/core replacement unit and, conversely, the unit which serves for bobbin/core replacement also has a second function as the vertical transporter.

The first and second horizontal transporters can be single track units, in which case the vertical transporter and bobbin/core replacement unit can have a single device engageable with the bobbins and cores, or a plurality of (preferably two) of such devices. The devices can be double arm levers rotatable about respective vertical axes, the arms with other ends being provided with means for the engagement of the cores or bobbins from below.

Since the transport time between two planes, specially when the distance between them is greater, determine whether the transport capacity of the system, it is preferred that the vertical transporter and bobbin core replacement unit be capable of transporting more than one bobbin or core in each displacement between the two planes. It should be apparent that a minimum of two bobbins or cores should be carried by the transporter in each direction of displacement to maximize the transport capacity. However, when three or more bobbins or cores are to be picked or carried by the vertical transport device, spatial considerations may intervene and make such increased numbers of bobbin carrying devices impractical.

A pair of such double arm devices on the transport unit has been found to be an optimum compromise between transport capacity and spatial requirements.

The double arm lever or device is preferably rotatable about a vertical axis at the center of the device and the devices can be driven by respective drives via controllers which enable simultaneous pick up of two bobbins or cores and simultaneous transfer of two cores or bobbins at the ends of the travel of the transport unit. Since the pitch, (i.e. spacing between bobbins and/or cores) at the respective horizontal transporter may be different, it is possible to provide the centers of the double arm devices so that they are at different spacings from first and second transport paths to correspond to the difference in pitch. The first and second transport paths may have straight tracks which are tangential to the circular orbits of the ends of the arms or such orbits along secants.

According to a feature, at least the second transporter may have two tracks which lie at different spacings from the axis of the double arm device and the two tracks may lie to one side of the double arm device or the two tracks may lie on opposite sides thereof.

The method of the invention for transporting full bobbins and empty bobbin cores or sleeves may thus comprise the steps of:

(a) displacing erect full bobbins along a first horizontal transport path in a first horizontal plane by suspending the full bobbins from hangers of the first horizontal transport path to a bobbin/core replacement station;

(b) engaging an erect full bobbin on the first horizontal transport path from below at the bobbin/core replacement station with a vertically displaceable transporter;

(c) shifting the transporter vertically to position the erect full bobbin at a second horizontal plane vertically spaced from the first horizontal plane;

(d) transferring the erect full bobbin positioned at the second horizontal plane to a second horizontal transport path in the second horizontal plane by suspending the erect full bobbin to a hanger of the second horizontal transport path; to a bobbin/core replacement station;

(e) engaging an erect empty bobbin core suspended from a hanger on the second horizontal transport path from below at the bobbin/core replacement station with the vertically displaceable transporter;

(f) shifting the transporter vertically to position the erect empty bobbin core at the first horizontal plane;

(g) suspending the erect empty bobbin core positioned at the first horizontal plane from a hanger of the first horizontal transport path;

(h) repeating steps (b) through (g) to transfer full bobbins from the first plane and the first horizontal transport path to the second plane and the second horizontal transport path and empty bobbin cores from the second plane and the second horizontal transport path to the first plane and the first horizontal transport path, thereby replacing full bobbins on the first transport path with empty bobbin cores and replacing empty bobbin cores on the second transport path with full bobbins; and (i) displacing erect full bobbins along the second horizontal transport path in the second horizontal plane away from the bobbin/core replacement station by suspending the full bobbins from hangers of the second horizontal transport path, and displacing empty bobbin cores along the first horizontal transport path away from the bobbin/core replacement station by suspending the empty bobbin cores from hangers of the first horizontal transport path.

The apparatus can comprise:

means forming a first horizontal path in a first horizontal plane and including hangers for suspending erect full bobbins during displacement of erect full bobbins by the first horizontal transport path to a bobbin/core replacement station;

a vertically displaceable transporter at the bobbin/core replacement station provided with means for engaging an erect full bobbin on the first horizontal transport path from below;

means for shifting the transporter vertically to position the erect full bobbin at a second horizontal plane vertically spaced from the first horizontal plane;

means forming a second horizontal transport path in the second horizontal plane and including hangers for suspending the erect full bobbin from the transporter on the second horizontal transport path;

means on the transporter for engaging an erect empty bobbin core suspending from a hanger on the second horizontal 5 transport path from below where the erect empty bobbin core is positioned on the first horizontal plane upon shifting of the transporter to the first horizontal plane, the first horizontal transport path suspending the erect empty bobbin core for displacement by the first horizontal transport path; and means for displacing the full bobbins and the empty bobbin cores while suspending same from the hangers along both the first transport path and the second transport path whereby the transporter serves simultaneously for transferring full bobbins from the first plane and the first horizontal transport path to the second plane and the second horizontal transport path and empty bobbin cores from the second plane and the second horizontal transport path to the first plane and the first horizontal transport path, thereby replacing full bobbins on the first transport path with empty bobbin cores and replacing empty bobbin cores on the second transport path with full bobbins.

In describing the method or apparatus of the present invention, may use the term "bobbin tube" to refer to the bobbin cores or sleeves and the term "hanger" to refer to any device engaging the full bobbin or an empty bobbin core from its upper end. It will be understood that devices which engage the full bobbins, also grip or engage the latter via the tubes on which the roving is wound. Furthermore, in the best mode currently known to me of carrying out the invention in practice, the horizontal transporters comprise tracks along which suspension or hanger carriages are disposed and the hanger carriages are interconnected or articulated to one another in at least one train. The drives for such trains of hangers are known in the art. Furthermore, in the best mode currently known to me, one of the horizontal transporters is provided above the roving frames while another of the horizontal transporters is provided above ring-spinning frames at a different level from the roving frames.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
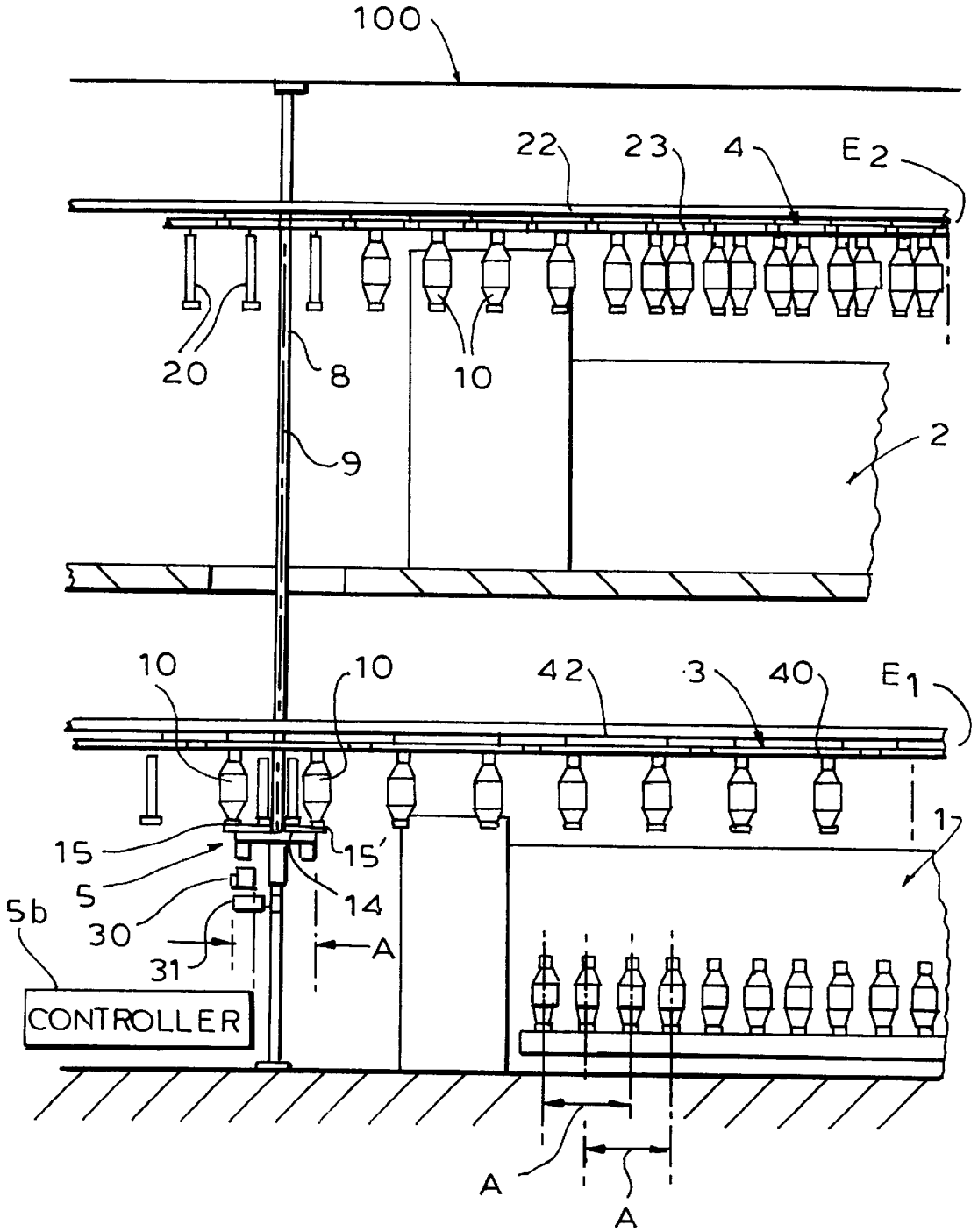
FIG. 1 is a diagrammatic section through a portion of a spinning mill having roving frames and ring-spinning frames, to illustrate the transfer of bobbins and cores between the two levels.
Figure 2:
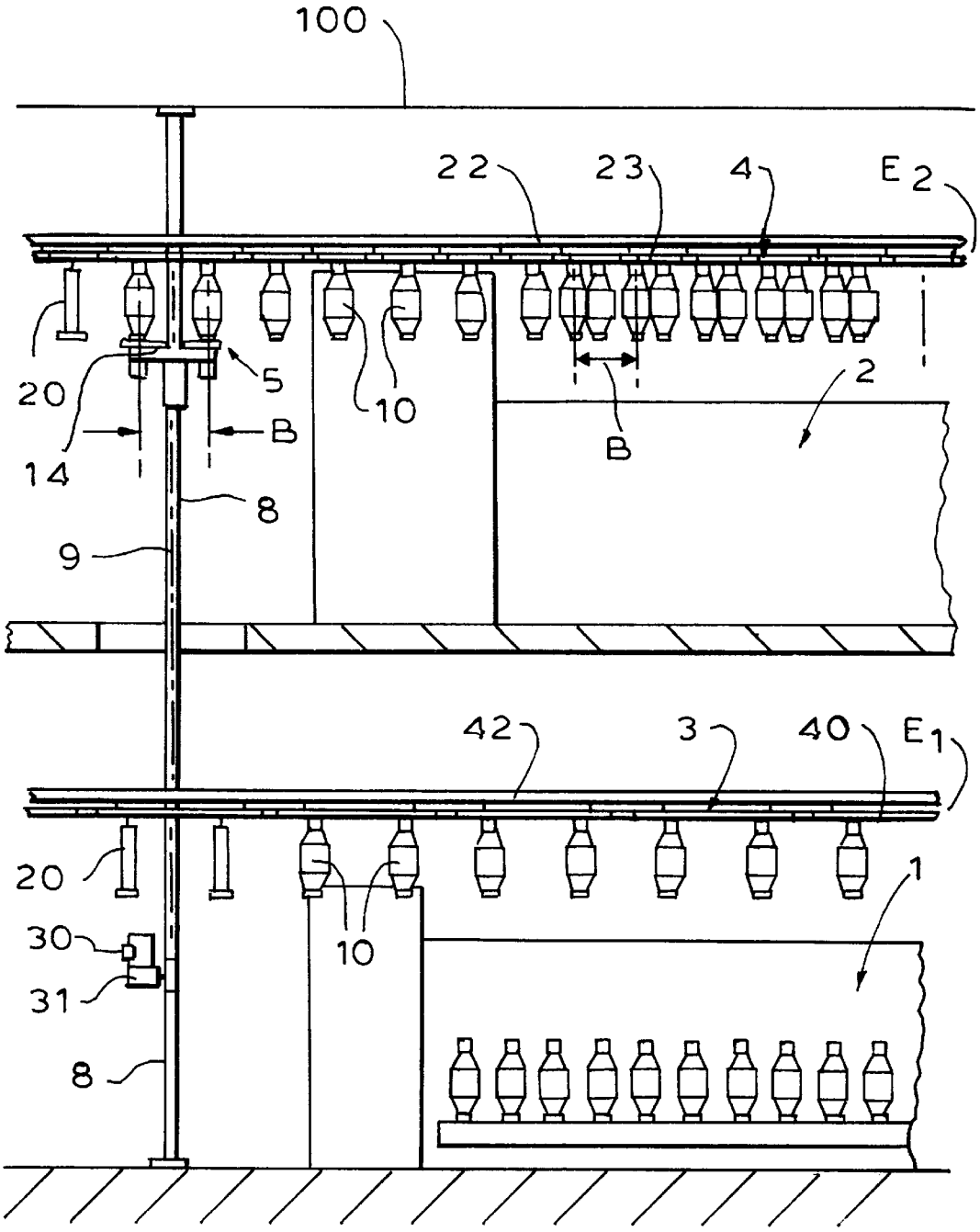
FIG. 2 is a section similar to FIG. 1 through a two story spinning mill showing the vertical transporter in its up position.

FIGS. 1 and 2 show a two-story spinning mill 100 having a lower floor or level which can be provided with machines of one type, for example roving frames, which have been broadly indicated at 1 and represent an earlier stage in a yarn making process. On the second level, representing a subsequent stage in the yarn making process, the machines 2 may be ring-spinning machines. Of course, any other sets of machines may be used with the understanding that full bobbins and empty sleeves, also known as core sleeves, on which yarn is to be wound to form the bobbins, are to be transferred between the levels and usually between two levels at which machines for different stages of the yarn making process are provided. The stage with the roving frames may, of course, include drafting frames for drafting the sliver or roving, fields of cans for supplying the sliver to a drawing or drafting frame and a roving frame, etc. The level with the machines for processing yarn at a later stage can include, in addition to ring spinning frames, twisters and the like and any drafting frame which may be associated with the roving frame, etc.

The level associated with the earlier processing of the yarn is provided with a horizontal transporter 3 in a horizontal plane $E_1$ and the transporter 4 for the ring-spinning level operates in a horizontal plane $E_2$ and each of these transporters is provided with hanger carriages or the like from which the full bobbins or the empty core sleeve may be suspended from its upper end during transport to and from the respective machines. In the drawing, full bobbins are shown at 10 and empty core sleeves are shown at 20. Each of the levels can be provided with storage regions in which rows of bobbins and core sleeves may be stored until needed and before or after transfer to the other level, depending upon the requirements of the equipment at the respective level.

Between the two horizontal transporters 3 and 4, the bobbins 10 and the sleeves 20 can be transferred by a vertical transporter represented generally at 5 in which the bobbins and sleeves remain upright and which also serves to replace a bobbin with an empty sleeve and thus can be considered a bobbin/sleeve replacement unit.

The spinning mill represented at 100 is only an example of yarn making systems utilizing different levels for different stages of the yarn making process and of a system in which a transfer of bobbins and sleeves with transporters of different levels is carried out. It will be understood that the mill shown is intended to represent any system in which a transfer of bobbins and sleeves with two levels may be desired, regardless of the specific purposes of the transporters at the respective levels. Thus it is intended to cover, in this category, systems in which both the earlier and the later processes in the yarn making operation are carried out at the same level.

The invention can also be used when the mill has more than two stories or levels or when the mill itself has a single level but, for some reason, transporters in different horizontal planes are used. In this case, on a single level there may be provided a transporter for the roving frames at a higher level and a transporter for a ring-spinning frame at a lower level of a single story structure.

In the embodiment shown, where the roving frames are at the lower level, the transporter 3 can be provided with a track 42 upon which a train 40 of suspension carriages can be displaced and which have hangers upon which the bobbins or sleeves can be engaged and which supply the bobbins and sleeves to the transport and replacement unit 5. The sleeves can be returned to the transporter 3 from the spinning level so that new roving bobbins may be wound thereon. The fully wound roving bobbins, upon transfer to the unit 5 are delivered to the transporter 4 and via the latter to the ring-spinning machines where those bobbins are emptied to leave core sleeves which are returned to the transporter 3 of the roving frames. The first transporter 3 can be formed with a single endless train, e.g. a transport chain, of interconnected suspension carriages.

The pitch of the hangers in this transporter is represented at A and usually corresponds to the mutual spacing of the bobbins 10 in each row of the roving frames 1. The transport and replacement unit 5 receives the bobbins 10 from the first transporter 3 and delivers these bobbins to the second transporter 4 and receives the empty sleeves from the second transporter and delivers these empty core sleeves to the first transporter. As a consequence, not only is the transporter 5 capable of shifting the bobbins and sleeves between vertically offset transporters but at the same time it also fulfills the replacement function and substitutes sleeves for bobbins in the first transporter and substitutes bobbins for sleeves on the second transporter. The unit 5 thus has a dual function. The transport and replacement unit 5 comprises, for this purpose a slide 14 to which an endless tension element 9 is connected. The tension element 9 extends along a guide 8, in the form of a vertical bar, rod or column along which the slide can travel, a drive motor 30 being provided for the tension element 9 to which the slide is connected. The motor 30 may have a speed reduction gearing or transmission 31 to reduce the speed at which the slide is driven between the planes $E_1$ and $E_2$.

Other drive mechanisms may be used as well. For example, the drive for the slide my be a leadscrew and nut arrangement, the leadscrew being driven by a motor. In that case the slide 14 should be secured against rotation. A groove and key arrangement, spline shaft or the like can be used for that purpose.

On the slide 14, there are provided two double-arm replacement devices in the form of double arm levers 15 and 15' rotatable about vertical axes 16, 16' (FIGS. 3*a*–3*d*) driven by separate drives 16*a* and 16*a'* and having a controller 16*b* for sequencing the drives and synchronizing them as may be required.

At the ends of the bobbin/core replacement levers 15, 15', pins 17 and 17' are provided for engaging in the bobbins 10 and the cores 20 from below so as to transfer the bobbins and cores in upright orientations. In the swinging of the levers 15 and 15', the pins 17 and 17' define respective orbits 18, 18' (see FIGS. 4–8) along which the bobbins 10 and the cores 20 can be engaged or released.

The second transporter 4 associated with the ring spinning machines, comprises a track 22 from which hanger carriages are suspended and in which, by contrast to the first transporter 3, these carriages are circulated in the form of an endless transport chain 23. The transport chain 23, of course, has hangers from which the bobbins 10 and the cores 20 are suspended from their upper ends. The pitch or spacing B (FIG. 2) of these hangers, corresponds to the mutual spacing of the bobbins in a creel of the ring-spinning machine. The second transport device 4 can, however, also be equipped with hanger carriage trains or groups of carriages as is analogous to the construction of the transporter 3.

The system of course includes a controller 5*b* for displacement of the slide 14, which controller can by synchronized with the controller 16*b* to effect sequencing of the vertical transporter 14 and synchronism between the latter and the movements of the horizontal transport units 3 and 4 and with the levers 15 and 15'.

The apparatus as described operates as follows. As can be seen from FIGS. 1 and 3*a*, the transport and bobbin/core replacement unit 5 can initially be in its lower position in the lower plane $E_1$ in which the transport device 5 can pick up full bobbins 10 from the first transporter 3. The suspension carriage train 40 arriving at the station at the left in FIG . 1, usually fully loaded with bobbins 10 or cores 20. The device 5 picks up two bobbins simultaneously from the train 40 and simultaneously transfers two cores 20 to the latter. In this case, the pins 17 and 17' of the levers 15 and 15' must have a spacing A corresponding to the pitch of the hangers of the suspension carriage train 40.

Figure 3B:
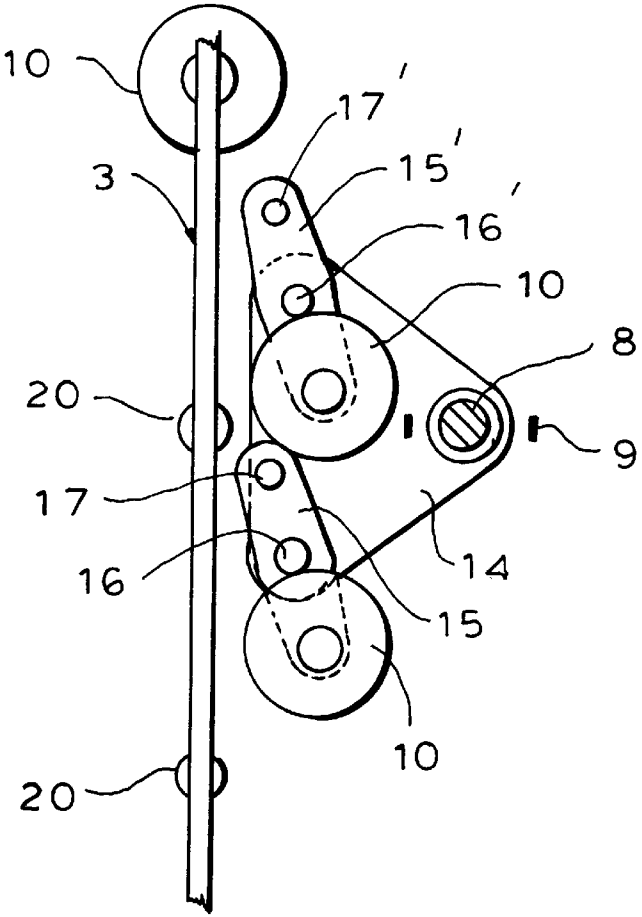
FIGS. 3*a*–3*d* are plan views of the bobbin/core replacement devices of the vertical transporter in different positions.
Figure 3A:
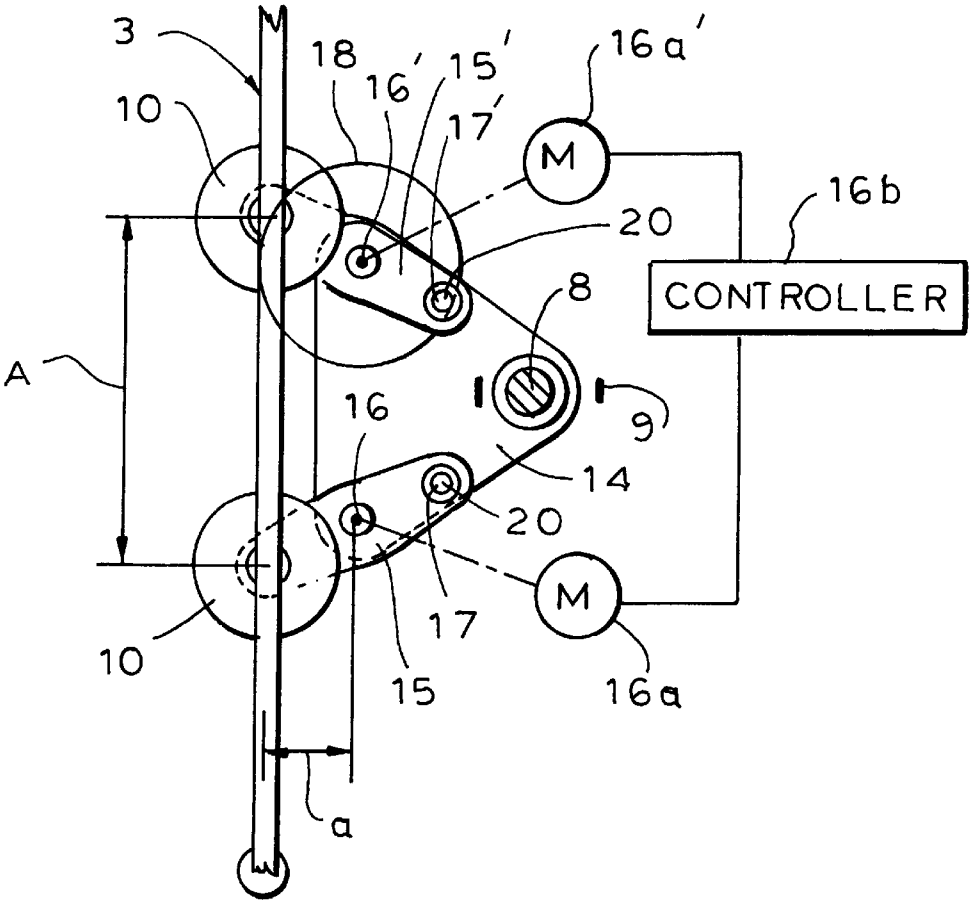
Figure 3D:
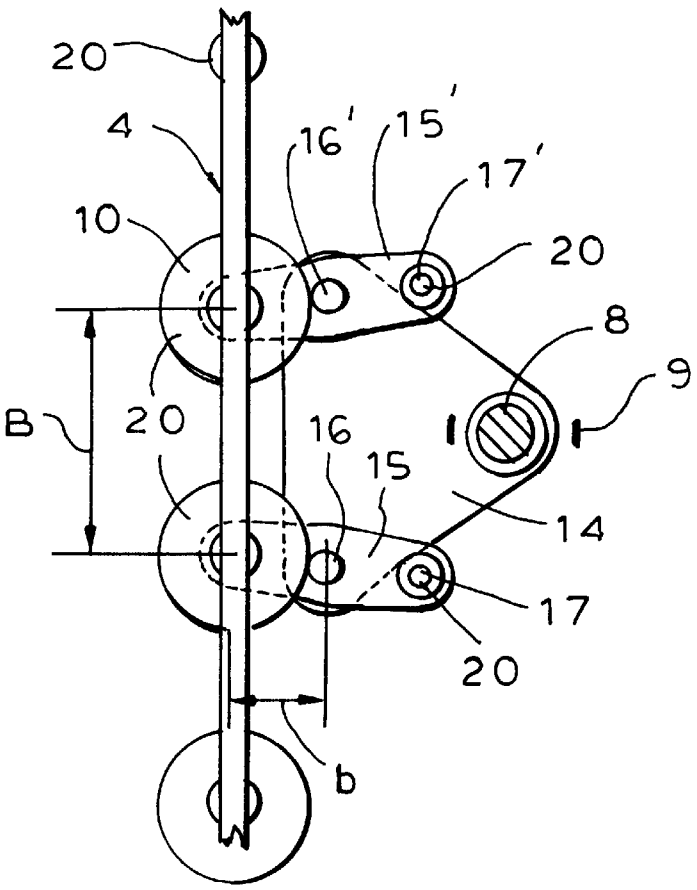

To achieve this, as can be seen in FIG. 3*a* the carriages of the train 40 are spaced apart at the distance A, i.e. with the pitch as indicated and the axes 16 and 16' are spaced from the track by a distance such that the orbits 18 and 18' of the pins 17 and 17' will be intersected by the track to afford the separation A. The levers 15 and 15' are swung through 180° so that sleeves 20 are aligned beneath the holders which have been emptied by removal of bobbins 10 therefrom and with a corresponding vertical movement of the carriage 14, the empty core sleeves can be locked into the hangers.

Then the levers 15 and 15' of the unit 5 can be swung into the position shown in FIG. 3b so that the arms clear the track. The slider 14 is raised and the bobbins 10 on the levers 15, 15' can be swung into alignment with the hangers so that, upon lowering of the carriage 14, the full bobbins are left on the hangers of the upper transporter 4.

The levers 15, 15' are then rotated again through 180° to bring their pin into alignment with core sleeves 20 on the track 4 and thereby engage a pair of empty core sleeves which are removed from the track 4.

Figure 3C:
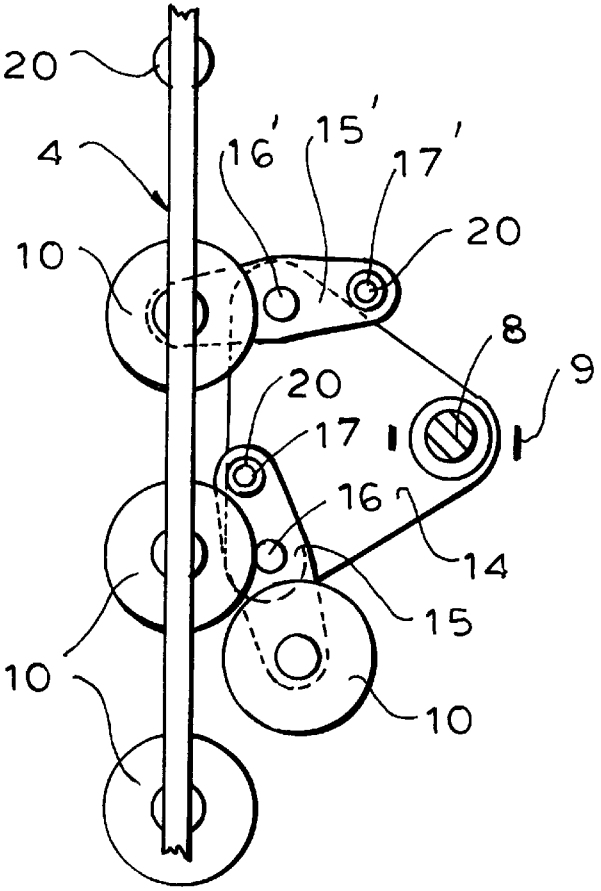

FIG. 3*c* shows that the track 4 can intersect the orbits of the levers 16 and 26' for the transfer of a bobbin to a hanger of this track. It also shows that the bobbins can be transferred one at a time (compare FIGS. 3*c* and 3*d*) where the bobbins are transferred two at a time.

When the bobbin replacement has been completed, the carriage 14 is lowered to the first plane $E_1$ and transfers the core sleeves which have been picked up at plane $E_2$ to the first transporter 3 to receive another pair of bobbins therefrom. In this sequence, two bobbins picked up from the first transporter and two core sleeves are mounted thereon whereas two bobbins are delivered to the second transporter and two core sleeves are picked up therefrom.

The second transporter can also be provided with suspension carriage trains which can be fitted unitarily with bobbins 10 or core sleeves 20 so that the transfer is effected in pairs. This have been represented in FIGS. 2 and 3*d*. Since the mutual spacing between the bobbins or core sleeves on the transporter 4, can, as representing by the spacing B be different from that on the transporter A, the spacing between the axes 16, 16' and the track of the second transporter can be different from the spacing, i.e. the spacing being represented in FIG. 4.

Endless transport chains in general have a random distribution of sleeves 20 or bobbins 10 thereon and in that case, the replacement is effected individually as has been described in connection with FIG. 3*c*.

With endless transport chains, the succession or core sleeves 20 or bobbins 10 is generally random and hence, as shown in FIG. 3*c*, generally an individual replacement of individual core sleeves 20 by bobbins 10 is required. That means that the suspension track need only intersect the orbit 18 or 18' or be tangential thereto since the pitch or spacing of the hangers need not be considered.

When the capacity of the system requires that two successive empty sleeves be replaced simultaneously by full bobbins in a single operating cycle of the vertical carriage or slider 14, it is important that the pins 17 and 17' be positioned with the separation or pitch of the hangers. In this case, the spacing of the pins can be established by the control unit 16*b* while the carriage or slide 14 is being displaced between the planes $E_1$ and $E_2$ so that there will be no time loss for establishing this spacing.

The invention can be embodied with various arrangements of the tracks 3 and 4 with respect to the circular orbits 18 and 18' of the pins or the ends of the arms 15, 15' as has been illustrated for some of these configurations in FIGS. 4 through 8. The tracks 3 and 4, of course, in these FIGS. represent the passes of the respective horizontal transporters past the cylinder 14 at the bobbin/core change station. The tracks and the orbits or bobbin/core change devices have been shown in these FIGS. in highly schematic form. The track of the first transporter 3 has been shown in dot dash lines and the track of the second transporter 4, at the different level, has been shown in a double dot dash line.

Where other tracks can additionally be provided, for example a second track for the second transporter, a triple dot dash line has been used.

Correspondingly, the pitch of the hangers on a track has been represented by the dimension A or B for the first and second transporter while the spacing of the track from the axes 16 and 16' by the bobbin/core change devices has been shown by the dimensions a and b for the tracks of the first and second transporter respectively, and by the distance c for the second track of the second transporter.

Figure 4:
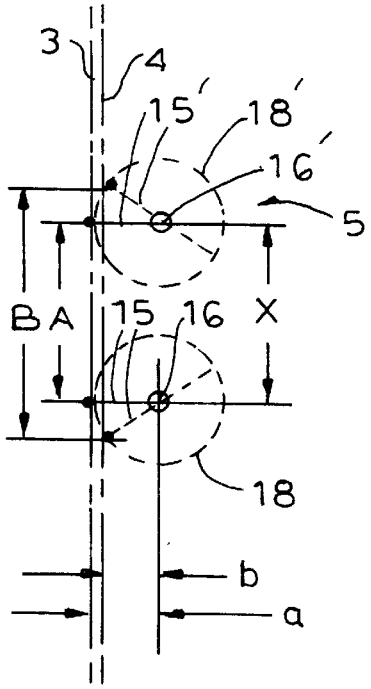
FIGS. 4–7 are diagrammatic plan views illustrating different orientations of the tracks of the horizontal transporters and the axes of the bobbin/engaging devices of the vertical transporter.

Thus in the embodiment of FIG. 4, the spacing X between the axes 16 and 16' is equal to the pitch A between the hangers of the first horizontal transport device and the distance a between the track 3 and the axes 16, 16' can be equal to a radius of the arm 15', 15' or of the orbit 18, 18'. The orbit 18, 18' is here tangential to the track 3 and for receiving a bobbin or sleeve or transferring a bobbin or sleeve, the levers 15, 15' are parallel to one another.

For the transfer at the second transporter 4, where the pitch of the hangers is B, the transporter track can lie at a distance b from the pivot axes 16 and 16' of the levers 15 and 15' and the controller 16b can set these levers into their double dot dash positions to allow for the greater pitch.

Figure 5:
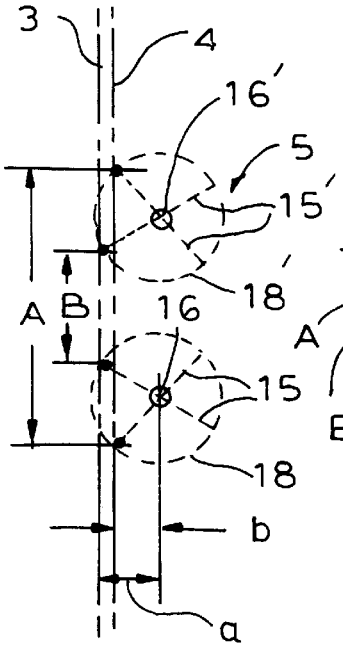

In the embodiment of FIG. 5, the spacing X of the axes 16 and 16' differs from the pitch A or B or both tracks and hence the levers or arms 15, 15' assume the dot dash or double dot dash positions in transverse at the first transporter 3 and the second transporter 4 and the transporters can lie at different distances a and b from the axis 16, 16' where both tracks intersect the orbits along secants.

Figure 6:
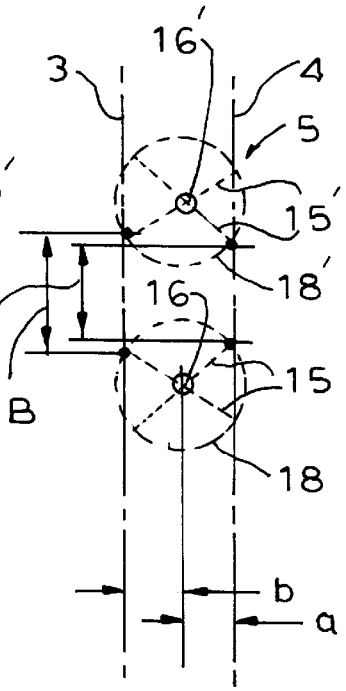

FIG. 6 shows the embodiment in which the suspension tracks 3 and 4 lie on opposite sides of the pivot axes 16 and 16'. This embodiment has the advantage of providing sufficient clearance for the upright bobbins and sleeves when the vertical offset of the transporters 3 and 4 is small, i.e. less than a length of the core sleeve so that the tracks may interfere with the swinging of the bobbins or cores from one track to the other.

Figure 7:
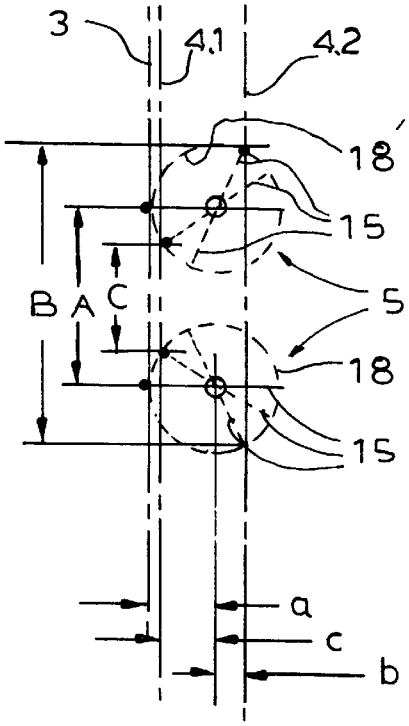

In the embodiment of the FIG. 7, the three tracks can have different distances from the axes 16 and 16' and the pitches A, B and C may all differ from one another as well. This is commonly the case when the second transporter has two separate transport chains which can be endless and can carry their hangers at different pitches.

When the first horizontal transporter 3 has a single hanger track along which suspension carriage trains with different pitches of their respective hangers can travel, it is possible to split the path by branches or switch tracks not shown to the track portions 4.1 and 4.2 which have been shown and then switch the trains back the main line. The system of FIG. 7 can thus accommodate a greater variety of hanger pitches.

It is also possible to provide the hanger tracks so that they are shiftable relative to the vertical plane of the axes 16 and 16' to vary the distance A, B or C and thus the locations at which the hanger track will intersect the orbits 18, 18' to accommodate the respective pitch.

The planes of the two transporters can coincide or be offset from one another, for example, in different stories of the plant. When they are at the same level, their tracks 4.1 and 4.2, however, lie on opposite sides of the vertical plane of the pivot axes 16 and 16'.

Figure 8:
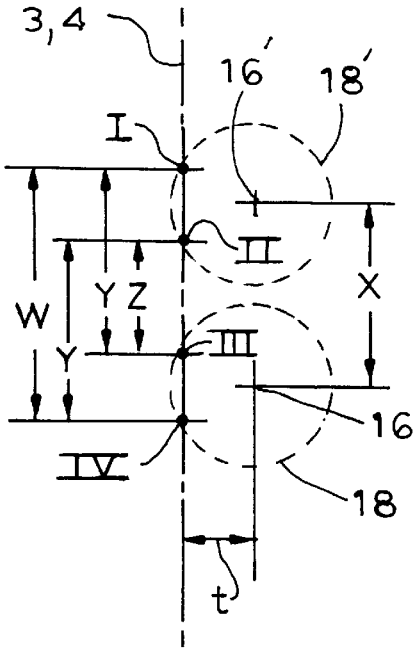
FIG. 8 is a diagram showing intersections between orbits of the double arm devices and horizontal transporter track.

As can be seen from FIG. 8, the spacing t between a hanger track of a horizontal transporter and the plane of the pivot axes 16, 16' of the levers 15 and 15' which is less than the radius of the circular orbits 18 and 18', can establish four intersection points which can correspond to three different pitches W, Y and Z of hangers on the respective transporter. The intersection points which can be used, depending upon the positions of the levers can be I and IV for the pitch W, II and III for the pitch Z and I and III or II and IV for the pitch Y.

The system allows in a simple way the replacement of full bobbins prepared at the roving level with empty core sleeves and the empty core sleeves retrieved at the spinning level by full bobbins, independently of the pitches of the hangers on the respective transporters and through the use of a simple system in which the core sleeves and the bobbins are always erect and are always suspended from above on the respective transporter but are engaged from below only by the transverse or vertical transporter.

The result is a rapid and uncomplicated bobbin/core replacement allowing the bobbins and cores to be engaged with the hangers with a rather simple up and down movement of the slider or carriage 14.

I claim:

1. A method of transporting full bobbins and empty bobbin cores in a yarn-producing mill, comprising the steps of:

(a) displacing erect full bobbins along a first horizontal transport path in a first horizontal plane by suspending said full bobbins from hangers of said first horizontal transport path to a first bobbin/core replacement station;

(b) simultaneously engaging two erect full bobbin on said first horizontal transport path from below at said bobbin/core replacement station with a vertically displaceable transporter;

(c) shifting said transporter vertically to position the two erect full bobbin at a second horizontal plane vertically spaced from said first horizontal plane;

(d) simultaneously transferring the erect two full bobbins positioned at said second horizontal plane to a second horizontal transport path in said second horizontal plane by suspending said erect full bobbin from hangers of said second horizontal transport path at a second bobbin/core replacement station;

(e) simultaneously engaging two erect empty bobbin core suspended from hangers on said second horizontal transport path from below at said second bobbin/core replacement station with said vertically displaceable transporter;

(f) shifting said transporter vertically to position the two erect empty bobbin core at said first bobbin/core replacement station in said first horizontal plane;

(g) simultaneously suspending the two erect empty bobbin cores positioned at said first horizontal plane from hangers of said first horizontal transport path;

(h) repeating steps (b) through (g) to transfer full bobbins from said first plane and said first horizontal transport path to said second plane and said second horizontal transport path and empty bobbin cores from said second plane and said second horizontal transport path to said first plane and said first horizontal transport path, thereby replacing full bobbins on said first transport path with empty bobbin cores and replacing empty bobbin cores on said second transport path with full bobbins; and (i) displacing erect full bobbins along said second horizontal transport path in said second horizontal plane away from said second bobbin/core replacement station by suspending said full bobbins from hangers of said second horizontal transport path, and displacing empty bobbin cores along said first horizontal transport path away from said first bobbin/core replacement station by suspending said empty bobbin cores from hangers of said first horizontal transport path.

2. A method of transporting full bobbins and empty bobbin cores in a yarn-producing mill, comprising the steps of:

(a) displacing erect full bobbins along a first horizontal transport path in a first horizontal plane by suspending said full bobbins from hangers of said first horizontal transport path to a first bobbin/core replacement station;

(b) engaging an erect full bobbin on said first horizontal transport path from below at said bobbin/core replacement station with a vertically displaceable transporter;

(c) shifting said transporter vertically to position the erect full bobbin at a second horizontal plane vertically spaced from said first horizontal plane;

(d) transferring the erect full bobbin positioned at said second horizontal plane to a second horizontal transport path in said second horizontal plane by suspending said erect full bobbin from a hanger of said second horizontal transport path at a second bobbin/core replacement station;

(e) engaging an erect empty bobbin core suspended from a hanger on said second horizontal transport path from below at said second bobbin/core replacement station with said vertically displaceable transporter;

(f) shifting said transporter vertically to position the erect empty bobbin core at said first bobbin/core replacement station in said first horizontal plane;

(g) suspending the erect empty bobbin core positioned at said first horizontal plane from a hanger of said first horizontal transport path;

(h) repeating steps (b) through (g) to transfer full bobbins from said first plane and said first horizontal transport path to said second plane and said second horizontal transport path and empty bobbin cores from said second plane and said second horizontal transport path to said first plane and said first horizontal transport path, thereby replacing full bobbins on said first transport path with empty bobbin cores and replacing empty bobbin cores on said second transport path with full bobbins; and (i) displacing erect full bobbins along said second horizontal transport path in said second horizontal plane away from said bobbin/core replacement station by suspending said full bobbins from hangers of said second horizontal transport path, and displacing empty bobbin cores along said first horizontal transport path away from said first bobbin/core replacement station by suspending said empty bobbin cores from hangers of said first horizontal transport path, and wherein, in step (b) a pair of erect full bobbins are simultaneously engaged by said transporter and in step (e) a pair of empty bobbin cores are simultaneously engaged by said transporter, and upon shifting of said transporter between said planes the spacing of the bobbins and cores of the respective pair is altered.

3. The method defined in claim 2 wherein each pair engaged at one of said horizontal transport paths is delivered simultaneously to the other of said transport paths.

4. The method defined in claim 2 wherein only one member of each of said pairs engaged at one of said transport paths is delivered at a time to the other of said transport paths.

5. An apparatus for transporting full bobbins and empty bobbin cores in a yarn-producing mill, comprising:

means forming a first horizontal path in a first horizontal plane and including hangers for suspending erect full bobbins during displacement of erect full bobbins by said first horizontal transport path to a bobbin/core replacement station;

a vertically displaceable transporter at said bobbin/core replacement station provided with means for simultaneously engaging two erect full bobbin on said first horizontal transport path from below;

means for shifting said transporter vertically to position the two erect full bobbins at a second horizontal plane vertically spaced from said first horizontal plane;

means forming a second horizontal transport path in said second horizontal plane and including hangers for simultaneously suspending the two erect full bobbin from said transporter on said second horizontal transport path;

means on said transporter for simultaneously engaging two erect empty bobbin core suspending from a hanger on said second horizontal transport path from below, said two erect empty bobbin cores being positioned in said first horizontal plane upon shifting of said transporter to said first horizontal plane, said first horizontal transport path receiving simultaneously the two erect empty bobbin cores for displacement by said first horizontal transport path; and means for displacing said full bobbins and said empty bobbin cores while suspending same from said hangers along both said first transport path and said second transport path whereby said transporter serves simultaneously for transferring full bobbins from said first plane and said first horizontal transport path to said second plane said second horizontal transport path and empty bobbin cores from said second plane and said second horizontal transport path to said first plane and said first horizontal transport path, thereby replacing full bobbins on said first transport path with empty bobbin cores and replacing empty bobbin cores on said second transport path with full bobbins.

6. The apparatus as defined in claim 5 wherein the first and second transport paths are single track paths and said transporter is provided with at least one device for simultaneous engagement with a respective pair of empty bobbin cores and full bobbins.

7. The apparatus as defined in claim 5 wherein said second transport path is formed with two tracks.

8. The apparatus as defined in claim 7 wherein said transporter is provided with a double arm device swingable about an axis and provided at its ends with means for engaging full bobbins and empty bobbin cores from below said axis lying between said tracks of the second transport path.

9. The apparatus as defined in claim 5 wherein said transporter is provided with a rotatable device engageable with said full bobbins and empty core sleeves from below, device and controlling means connected to said positioning said device relative to said transport paths.

10. The apparatus as defined in claim 9 wherein said transporter is provided with a device having two double armed levers fulcrumed at respective centers and formed with means at opposite ends of each lever for engaging a full bobbins and empty bobbin core from below, and controlling means connected to said device for positioning said device relative to said transport paths.

11. An apparatus for transporting full bobbins and empty bobbin cores in a yarn-producing mill, comprising:

means forming a first horizontal path in a first horizontal plane and including hangers for suspending erect full bobbins during displacement of erect full bobbins by said first horizontal transport path to a bobbin/core replacement station;

a vertically displaceable transporter at said bobbin/core replacement station provided with means for engaging an erect full bobbin on said first horizontal transport path from below;

means for shifting said transporter vertically to position the erect full bobbin at a second horizontal plane vertically spaced from said first horizontal plane;

means forming a second horizontal transport path in said second horizontal plane and including hangers for suspending the erect full bobbin from said transporter on said second horizontal transport path;

means on said transporter for engaging an erect empty bobbin core suspending from a hanger on said second horizontal transport path from below where said erect empty bobbin core is positioned on said first horizontal plane upon shifting of said transporter to said first horizontal plane, said first horizontal transport path suspending the erect empty bobbin core for displacement by said first horizontal transport path; and means for displacing said full bobbins and said empty bobbin cores while suspending same from said hangers along both said first transport path and said second transport path whereby said transporter serves simultaneously for transferring full bobbins from said first plane and said first horizontal transport path to said second plane said second horizontal transport path and empty bobbin cores from said second plane and said second horizontal transport path to said first plane and said first horizontal transport path, thereby replacing full bobbins on said first transport path with empty bobbin cores and replacing empty bobbin cores on said second transport path with full bobbins, and wherein the first and second transport paths are single track paths and said transporter is provided with at least one device for engagement with a respective empty bobbin core and full bobbin, said device including a double arm member rotatable about an axis and provided at its ends with means for engaging said full bobbins and said empty bobbin cores from below.

12. The apparatus as defined in claim 11 wherein said transporter and said device are constructed so that said axis has different spacings from said tracks when said transporter is positioned at the respective horizontal planes.

13. The apparatus as defined in claim 12 wherein said tracks are tangential to orbits of said ends.

14. The apparatus as defined in claim 12 wherein said tracks intersect orbits of said ends along secants.

15. The apparatus as defined in claim 12 wherein both said tracks lie on one side of said axis.

16. The apparatus as defined in claim 12 wherein said axis lies between the tracks of said first and second transport paths.

* * * * *